United States Patent [19]

Gregersen

[11] Patent Number: 4,959,003

[45] Date of Patent: Sep. 25, 1990

[54] DEVICE FOR DIE-CASTING OF CONCRETE GOODS SUCH AS BLOCK STONES IN A CELLULAR MOULD

[75] Inventor: Agner R. Gregersen, Viborg, Denmark

[73] Assignee: KVM Industrimaskiner A/S, Kjellerup, Denmark

[21] Appl. No.: 263,795

[22] PCT Filed: Feb. 23, 1988

[86] PCT No.: PCT/DK88/00032

§ 371 Date: Oct. 24, 1988

§ 102(e) Date: Oct. 24, 1988

[87] PCT Pub. No.: WO88/06084

PCT Pub. Date: Aug. 25, 1988

[30] Foreign Application Priority Data

Feb. 23, 1987 [DK] Denmark ..... 899/87

[51] Int. Cl.[5] ..... B28B 1/08; B28B 3/02; B28B 13/02; B30B 5/00

[52] U.S. Cl. ..... 425/346; 100/237; 100/258 R; 100/258 A; 264/297.9; 264/333; 425/193; 425/254; 425/260; 425/413; 425/419; 425/421; 425/432; 425/448

[58] Field of Search ..... 264/333, 297.1, 297.8, 264/297.9; 425/417, 412, 419, 346, 193, 254, 260, 413, 421, 432, 448; 100/237, 258 R, 258 A

[56] References Cited

U.S. PATENT DOCUMENTS

| | | | |
|---|---|---|---|
| 2,909,826 | 10/1959 | McElroy | 425/421 |
| 3,030,878 | 4/1962 | Hölzer | 100/237 |
| 3,890,413 | 6/1975 | Peterson | 264/334 X |
| 4,142,933 | 3/1979 | Graham | 425/412 X |
| 4,545,754 | 10/1985 | Scheidt et al. | 425/412 X |
| 4,802,836 | 2/1989 | Whissell | 425/253 |

FOREIGN PATENT DOCUMENTS

| | | | |
|---|---|---|---|
| 2406688 | 8/1975 | Fed. Rep. of Germany . | |
| 0677952 | 8/1979 | U.S.S.R. | 100/237 |
| 2139550A | 11/1984 | United Kingdom . | |

*Primary Examiner*—Jan H. Silbaugh
*Assistant Examiner*—Karen D. Kutach
*Attorney, Agent, or Firm*—Antonelli, Terry, Stout & Kraus

[57] ABSTRACT

A system for die casting of concrete goods such as block stones comprises a cellular casting mould having a plurality of cells and a device for supplying concrete for filling the cells. A dolly including a common base member with protruding pistion portions having load plates of a shape corresponding to that of the cells, is used for compressing the concrete in the cells. Each of the piston portions includes a resilient compressible material arranged between the load plates and the common base member for obtaining uniform density and strength in the goods in the respective cells.

4 Claims, 2 Drawing Sheets

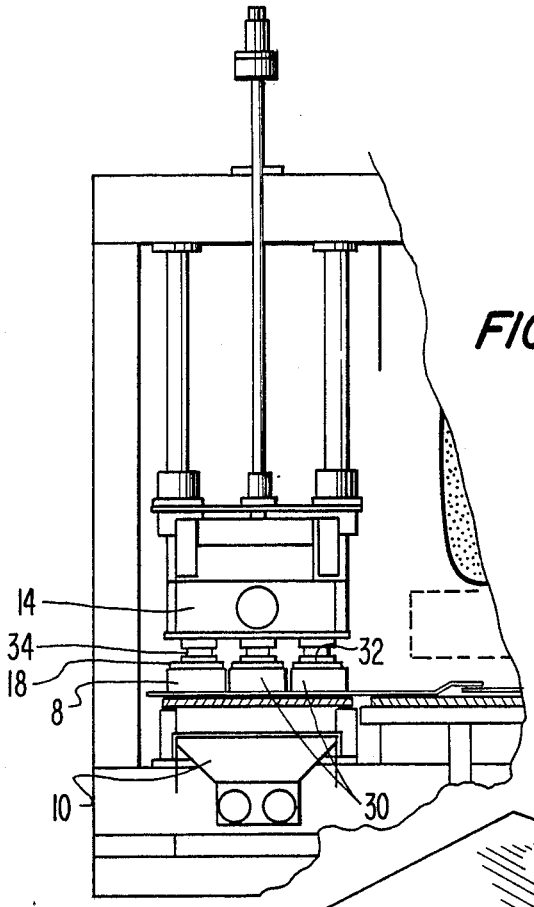
FIG. 2
FIG. 3
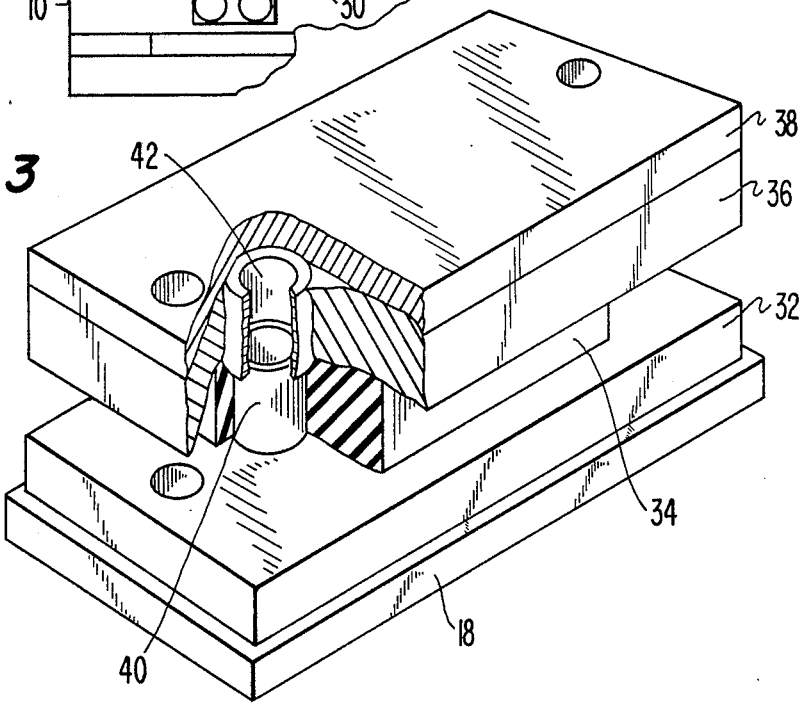

DEVICE FOR DIE-CASTING OF CONCRETE GOODS SUCH AS BLOCK STONES IN A CELLULAR MOULD

BACKGROUND AND SUMMARY OF THE INVENTION

The present invention relates to a method for die-casting of concrete goods such as block stones, which are cast in a cellular casting mould by this being completely filled with concrete, whereafter a superjacent holder-on or dolly provided with mutually flush load plates having a shape corresponding to the respective subjacent cell shapes is pressed down against the concrete surface for compression of the casting material in the individual cells, preferably during vibration of the casting material from the underside of the mould. After the required compression, the dolly is lifted from the mould, and the moulded stone bodies are demoulded.

For the supply of concrete to the mould cells, a so-called filler cart is normally used, which with its bottom open is deplaced from a position in which it is placed on a fixed bottom plate underneath the outlet for casting concrete from a silo, whereby it will bring a charge of concrete over the mould and during its return movement scrape off the excess amount of concrete for which there has been no room in the cells. Thus, the mould is left with a smooth concrete surface level with the upper edges of the partitions between the cells.

Thereafter, the downwards pressing of the dolly is effected, e.g. by hydraulic power, the dolly being moved parallelly for obtaining that all the stones are compressed to the same height. Because of variations of the processing conditions and of the character of the casting concrete, the height of the stones will not always be the same, but as a height variation of ±2 mm is normally accepted, the result will almost always be usable anyway.

The stones must meet the requirement that their strength must be as good as possible, and that there must be only a small variation of the strength of the different stones of the production. As a certain stone strength variation inevitably occurs, the problem occurs in practice that for ensuring a desired minimum strength, it is necessary to use so much cement in the casting concrete that the weakest stones have the concerned minimum strength, whereby the other stones within the scope of variation will have an unnecessarily high cement content, i.e. generally the production requires, in reality, an unnecessarily high consumption of cement, which is a considerable disadvantage, economically as well as resource-wise.

The invention, which aims at fighting this disadvantage, is based on the consideration that the strength of the stone bodies is proportional to their density, and that thus, the strength variation will primarily be a question of density variations in the achieved result of the compression. By effecting that the density variations are equalized, the cement may thus be dosed in a better optimized manner for obtaining a cement economy in the running production, which justifies even a rather costly modification of the mould equipment.

The said stone strength variation is primarily caused by the fact that by the used simple method of casting concrete supply, an entirely uniform or compact filling of the cells is not obtained, as, locally, there may be more or less air in the concrete, and as this air only escapes by the compression and the vibration of the concrete, it is not possible in advance to effect any individual adjustment for obtaining a uniform result.

The invention is furthermore based on the observation that the normally occurring variation in the weight quantity of concrete of a uniform and good quality filled into the cells amounts to appx. 4%, which by an individually impressed compression pressure of a normal magnitude gives a resulting height difference of appx. 3 mm for typical block stones. When the products are compressed to the same height, the best filled cells will correspondingly give products having the highest density and thus the best strength. What is noticable here, however, is that the said height difference between products which have been individually compressed and thereby compressed to more or less the same density and strength is smaller than the pre-accepted height difference tolerance. This means that by controlling the production fairly closely with respect to concrete quality and processing parameters, it is necessary to use only a small part of the thickness tolerance for those variations which are caused by these conditions, while the rest of the tolerance interval may be used for obtaining a uniform density and strength by effecting an individual compression of the concrete in the different cells, whereby it is possible to continue using the said, very simple concrete supply method.

Thus, by the invention care is taken that the load plates of the dolly are pressed against the concrete in the individual cells with primarily the same force, but in a mutually independent manner with regards to movement. This may be obtained by each load plate being placed individually on an operation cylinder, these cylinders being carried on a common dolly base and supplied with pressure from the same pressure source, but as in practice only relatively small thickness variations for the stone members are concerned, it is fully sufficient to use load plates which are connected to the common dolly base through resiliently compressible means. These may easily be shaped such that for the resulting pressure force it will be of no special importance whether the load plate penetrates a few millimeters more or less down into the mould cells.

In the following, the invention, which also comprises the concerned moulding equipment, is described in more detail with reference to the drawings.

BRIEF DESCRIPTION OF THE DRAWINGS

FIG. 2 is a section of the same view shown with the filler cart removed from the mould and with a dolly modified according to the invention, and FIG. 3 is a detailed view of a part of the dolly by another embodiment of the invention.

DETAILED DESCRIPTIONS OF THE DISCLOSED EMBODIMENT

Figure 1:
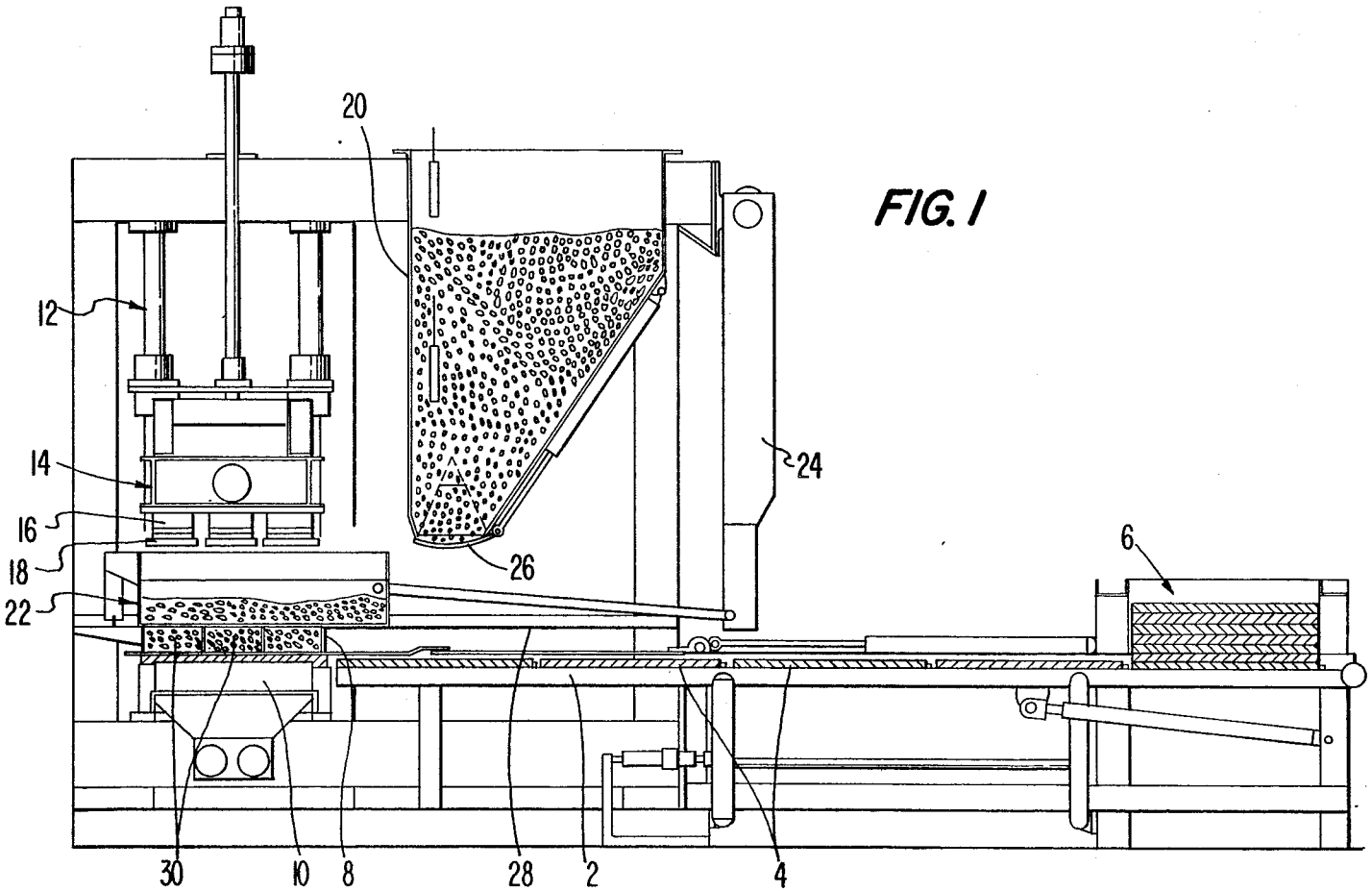
FIG. 1 is a side view of a conventional production system for concrete block stones, shown during filling of the casting mould.

The system shown in FIG. 1 comprises as main components a conveyor 2 for mould base plate members 4 fetched from a storage 6, a cellular mould 8 conveyed in a manner not shown to a base plate member 4 in a moulding station upon a vibro table 10, and underneath a carrier construction 12 for a dolly 14 having downwardly projecting pistons 16 for insertion down into the individual moulding cells in the mould 8. For this purpose the pistons 16 are provided with lower load plates 18 which may be exchangeable, and the shape of which corresponds to the cross sectional shape of the moulding cells, which may have a simply rectangular shape or various more complex shapes.

Further main components provided are a silo 20 for ready-mixed casting concrete, and a downwardly open filler cart 22, which by means of a moving mechanism 24 is movable back and forth between a position underneath an openable bottom outlet 26 of the silo 20, where the filler cart is supported on a fixed bottom plate member 28, and the shown position on top of the casting mould 8, in which position the casting concrete in the filler cart may sink down into the cells in the casting mould 8. When the filler cart 22 is thereafter moved back to the position underneath the silo 20 it will scrape the top surface of the mould 8 clean from excess casting concrete, such that the cells therein, designated 30, will be entirely filled with concrete.

Thereafter the vibro table 10 is started, and the dolly 14 is lowered until the load plates 18 engage the top surface of the concrete in each of the moulding cells 30. The dolly 14 is forced further downwards by hydraulic action, such that the load plates 18 have a compressing effect on the simultaneously vibrated concrete material in the mould cells 30. Optionally, also the dolly 14 may contain a vibrator.

By the invention the rigid pistons 16 on the dolly 14 are replaced by either separately activatable pistons or -preferably-resiliently yielding pistons, which is illustrated in FIG. 2, where the dolly 14 is shown in its lowered position after withdrawal of the filler cart 22. The load plates 18 will now compress the casting material with practically the same force in all the moulding cells 30, and the final result will be that the ready-pressed stone members may have mutually different heights, but more or less the same density and strength, while the height variation of the stones will be within the thickness interval which is already generally acceptable.

In FIG. 3 is shown a preferred embodiment of the pistons depending from the dolly 14, the pistons being terminated lowermost by the said load plate 18, which may be of a rectangular or any other relevant shape. The load plate 18 is screwed on to a thrust pad 32 which is fastened to the underside of a resiliently compressible unit or a rubber block 34, which at its top side is fixed to a plate block or plate member 36 fastened to the underside of a lower carrier plate 38 of the dolly 14. Near a peripheral area of the resilient block 34 an upwardly projecting guide pin 40 is placed on the thrust pad 32, the guide pin extending upwards through a hole in the rubber body 34 and being received in an optionally pipe lined cavity 42 provided in the plate block 36, whereby the thrust pad 32 with the load plate 18 is kept from being rotatable relative the carrier plate 38, while it may move up and down unobstructed relative this plate by resilient compression of the body 34.

For ensuring a correct function of the equipment, position sensors may be used for sensing the position of both the dolly 14 in general and the thrust pads 32 individually. It should be ensured that all the thrust pads are activated by compression of the rubber blocks 34 to a position corresponding to a predetermined dolly pressure, and that none of the thrust pads are "pressed home" after a further travel of slightly less than the general thickness tolerance for the produced goods, e.g. 3–3½ mm by a tolerance of 4 mm.

I claim:

1. A system for die casting of concrete goods, comprising a cellular casting mould having a plurality of cells and means for supplying concrete thereto for filling the cells and a superjacent dolly including a common base member having a plurality of resiliently yielding, protruding piston portions, each piston portion having at its lower end a load plate of a shape corresponding to the cross sectional shape of a corresponding cell, which load plates are pressable down into the cells for compressing the concrete therein, and which piston portions are mutually axially movable for providing that the load plates assume variable final levels due to differently compressible cell fillings, and wherein each of the piston portions comprises the load plate having a thrust pad fixed thereto, upon which thrust pad a resiliently compressible unit is fixed, and upon which resiliently compressible unit a plate member is fixed, which plate member is for mounting the resiliently yielding piston potions onto the common base member of the dolly by means of a lower carrier plate of the dolly.

2. A system according to claim 1, wherein at least one upwardly projecting guide pin is provided on each thrust pad for engagement with a cavity in each corresponding plate member by extending through each corresponding resiliently compressible unit for stabilizing each thrust pad and corresponding load plate so that each thrust pad and corresponding load plate are kept from being rotatable relative to each corresponding lower carrier plate of the dolly.

3. A system according to claim 1, wherein the load plates are of rectangular shape and the thrust pads are each provided with an upwardly projecting guide pin near each end of the corresponding load plate.

4. A system according to claim 3, wherein the upwardly projecting guide pins are entirely enclosed by the resiliently compressible units of the resiliently yielding piston portions.

* * * * *